US007237969B2

(12) United States Patent
Bartman

(10) Patent No.: US 7,237,969 B2
(45) Date of Patent: Jul. 3, 2007

(54) DUAL OUTPUT TRAY

(75) Inventor: David A. Bartman, Webster, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 11/244,262

(22) Filed: Oct. 5, 2005

(65) Prior Publication Data

US 2007/0077110 A1 Apr. 5, 2007

(51) Int. Cl.
*B41J 13/00* (2006.01)

(52) U.S. Cl. ..... 400/646; 400/691; 400/693; 399/405; 399/397

(58) Field of Classification Search ..... 400/646, 400/626, 691, 693; 399/405, 397
See application file for complete search history.

(56) References Cited

U.S. PATENT DOCUMENTS 3,807,726 A * 4/1974 Hope et al. ..... 271/207
4,191,467 A * 3/1980 Schieck ..... 355/75
4,993,701 A * 2/1991 Tosserams ..... 271/207
5,081,487 A * 1/1992 Hoyer et al. ..... 355/75
5,111,252 A * 5/1992 Hamada et al. ..... 399/393
5,190,279 A 3/1993 Morris et al.
5,237,361 A * 8/1993 Cardoos et al. ..... 396/638
5,241,353 A * 8/1993 Maeshima et al. ..... 399/405
5,913,628 A 6/1999 Sides, II
5,924,808 A 7/1999 Sides, II
6,032,004 A 2/2000 Mirabella, Jr. et al.
6,428,000 B1 * 8/2002 Hara et al. ..... 271/223
6,553,207 B2 * 4/2003 Tsusaka et al. ..... 399/401
6,568,865 B1 * 5/2003 Fujioka et al. ..... 400/647.1
6,824,129 B2 11/2004 Sides, II
6,830,401 B1 12/2004 Hwang et al.

* cited by examiner

*Primary Examiner*—Ren Yan
*Assistant Examiner*—Matthew Marini
(74) *Attorney, Agent, or Firm*—Gibb & Rahman, LLC

(57) ABSTRACT

Embodiments herein comprise a printing/copying media output device or terminal that includes a single media output tray that can be used as a flat tray or a basket tray. The media output tray has a first portion that connects to a media output device, a second portion at the opposite (distal) end of the first portion from the media output device, and a hinge between the first portion and the second portion connecting the first portion to the second portion. In some embodiments herein, the hinge is positioned at an approximate midpoint of the output tray and the first portion is approximately the same size as the second portion. By folding the tray at the hinge, the tray can be converted from a flat tray to a basket tray.

20 Claims, 4 Drawing Sheets

FIG. 1
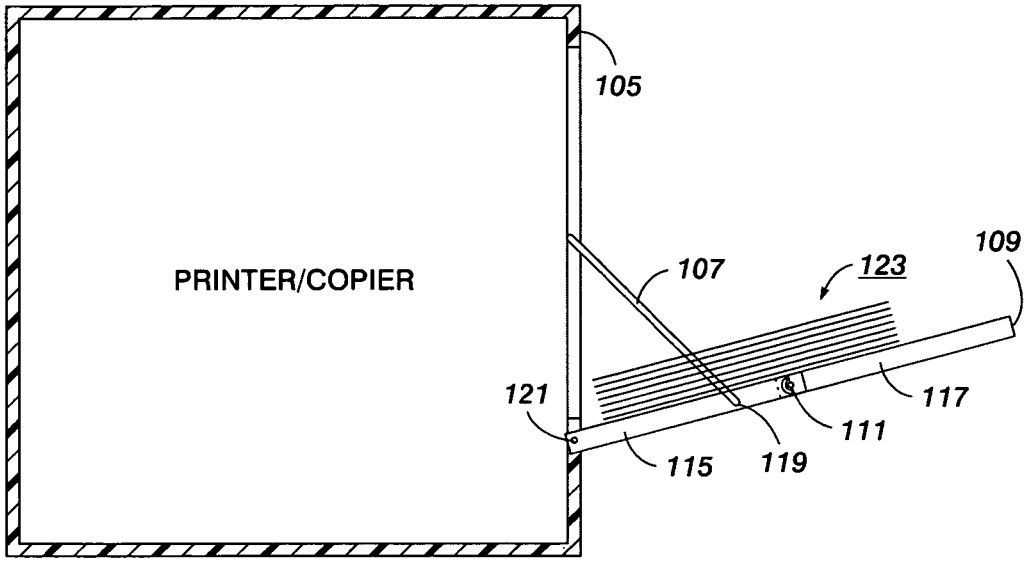
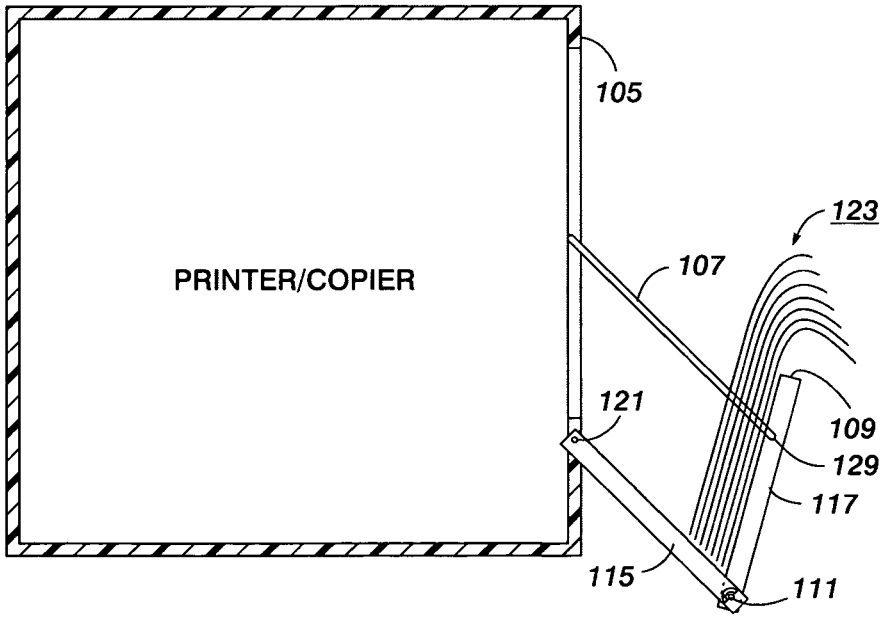
FIG. 2

DUAL OUTPUT TRAY

BACKGROUND

The present disclosure relates to printer/copier output trays. U.S. Pat. No. 6,830,401 discloses conventional structures for flat printer/copier output trays. U.S. Pat. No. 6,824,129 discloses conventional structures for basket printer/copier output trays. Both patents and the patents (and disclosures to which they refer) are fully incorporated herein by reference.

The structure shown in FIG. 5 is similar to the structure shown in U.S. Pat. No. 6,830,401, mentioned above. In FIG. 5, the printer 100 has an input tray 200 and an output tray 300 connected to the printer 100 body 400 at a connection point 460. The input tray 200 and the output tray 300 can include respective input and output print media support surfaces 210 and 310. The support surfaces 210 and 310 can be configured to support an entire piece of print media having, for example, dimensions 8½ inches by 11 inches, such as a conventional standard size paper and/or A4 paper, etc.

The support surface 310 can include a surface formed by extending the output stop 330. The support surfaces 210 and 310 may only support a portion of a piece of print media. The support surfaces can be flat or curved and can have cavities where a portion of the print media is not supported. By way of example only and not by limitation, the cavity 320 for the output stop 330 of the output tray 300 could result in portions of the output print media not being supported by the other output print media support surfaces 305,310. This could also be the case with the input print media support surface 210.

The input tray 200 and the output tray 300 can be configured to rotate from an open position to a closed position. However, the trays 200 and 300 can be open and closed in a different manner. In this regard, any means that will result in the opening and the closing of the trays of the printer can be used.

The input print media support surface 210 of the input tray 200 is positioned outboard of the output print media support surface 310 of the output tray 300 (i.e., the input print media support surface 210 is positioned a distance further from the center of the printer 100 than the output print media support surface 310) when the input tray and the output tray are in the closed position. This is a result of the rotation of the input tray 200 to the closed position, where the input tray 200 is positioned below the output tray 300 when the trays are in the open position. However, it is noted that the output print media support surface 310 of the output tray 300 could be positioned outboard of the input print media support surface 210 of the input tray 200 when the input tray 200 and the output tray 300 are in a closed position. This could be the case, by way of example, when the input tray 200 is positioned above the output tray 300 when the trays are in the open position.

FIG. 6 is similar to the structure disclosed in U.S. Pat. No. 6,824,129. In FIG. 6, the printer device includes a body or housing 22 in which the various operating components, e.g., paper transport mechanism 32, 34, 36, 38 print heads (P) 40, 42,44, 46, etc., are located and to which a power supply 14 is connected. The printer 20 includes a multi-directional paper or sheet input tray 24. The tray 24 is constructed to hold a stack of plural paper sheets 10 or other printable sheet material (media), and to enable such sheets to feed to the printer from the top of the stack/tray (i.e., a "top feed" tray) or can be constructed to feed from the bottom of the stack/tray (i.e., a "bottom feed" tray). The bottom of the tray is defined as that part of the tray which supports the paper. The input tray can be used with cam-type pick up roller printers.

Irrespective of the type of the input tray 24, the printer 20 itself is configurable to enable it to be disposed in one of two orientations so that when the device 20 is located on the wall 11, or on some other vertically oriented surface, its input tray 24 is in a generally vertical direction and when the device 20 is located on the shelf 13 or on some other horizontally oriented surface its input tray 24 is also in the generally vertical direction. It should be noted that the paper input tray 24 can be oriented so that it is in a precise vertical orientation, or it may be directed in a generally vertical orientation, e.g., at some acute angle with respect to horizontal. Moreover, that acute angle can be relatively large, e.g., 45 degrees or more, to enable each sheet of paper 10 or other printable material to make use of gravity to effect or facilitate the entry of the each sheet of paper or other printable material into the device 20. Thus, the term "generally vertical direction" as used hereinafter should be understood to have a broad meaning. It should be noted that if the tray is in a precisely vertical orientation it would need some modification to keep the paper in it from falling forward. In the printer shown, the input tray is limited to two positions. By widening the space that the paper enters the printer from the rotary device, one can readily provide a printer enabling one to adjust the tray somewhat (e.g., 5 degrees) at those positions.

The printer 20 also includes a dual directional outlet or exit port 26 located at a lower point on the housing and through which paper or other printable sheet material that have been printed with indicia by the print head of the printer exit for collection. In order to collect the printed sheets 10 exiting from the printer's outlet 26, the device includes an outfeed or outlet tray 28. The outlet or outfeed tray 28 is in the form of a basket hingedly mounted adjacent the outlet 26 so that it is oriented in a generally vertical direction, e.g., either precisely vertical or at some acute angle to vertical. The basket may be constructed in accordance with the teachings of U.S. Pat. No. 5,924,808, (the complete disclosure of which in incorporated herein by reference) wherein the basket section is collapsible, or may be of a fixed shape and configuration, e.g., molded, of plastic such as that of U.S. Pat. No. 5,913,628 (the complete disclosure of which in incorporated herein by reference)

Thus, the tray/basket 28 can be a preformed unit that is hingedly connected to the device 20 so that it is suspended from the device and hangs in a generally vertical direction irrespective of whether the device is mounted vertically or horizontally. Moreover, the basket/tray 28 is constructed so that its front wall 28A extends at an acute angle to vertical. Further, the back wall has a first upper section 28D and a second lower section 28B that can be at an angle, or parallel to the front wall 28A so that a basket structure is formed that will hold the sheets of paper 10 and prevent the sheets of paper 10 from falling out of the basket tray 28.

SUMMARY

Embodiments herein comprise a printing/copying media output device or terminal that includes a single media output tray that can be used as a flat tray or a basket tray. The media output tray has a first portion that connects to a media output device, a second portion at the opposite (distal) end of the first portion from the media output device, and a hinge between the first portion and the second portion connecting the first portion to the second portion. In some embodiments herein, the hinge is positioned at an approximate midpoint of the output tray and the first portion is approximately the same size as the second portion. By folding the tray at the hinge, the tray can be converted from a flat tray to a basket tray.

The hinge maintains a relative position between the first portion and the second portion. When in a first tray position, the first portion and the second portion form a flat output tray. Thus, in the first tray position, the first portion lies in the same approximate plane as the second portion and the angle between the first portion and the second portion is approximately 180 degrees. When in a second tray position, the first portion and the second portion form a basket tray. Thus, when in the second tray position, the first portion does not lie in the same approximate plane as the second portion and an angle between the first portion and the second portion is less than approximately 90 degrees. Media lies flat on the media output tray when in the first tray position, and the media sits between the first portion and the second portion, with one end of the media resting on the hinge when in the second tray position.

A support, such as a cable or bar, can be connected between the output tray and the media output device. The support is connected to the first portion when in the first tray position, and the support is connected to the second portion, when in the second tray position. In addition, a second hinge connects the first portion to the media output device to allow the angle of the tray to be changed with respect to the printer/copier and to allow the tray to be completely folded out of the way when not in use.

Therefore, as shown below, embodiments herein provide a single media output tray that can be used as both a flat tray and as a basket tray. This provides the user with increased flexibility regarding positioning of the printer and accommodates user preferences by providing the user with a choice between flat and basket output trays, without having to supply two separate trays. Further, embodiments herein provide a simple and easy way in which to change the tray by allowing the user to adjust the support or simply allowing the user to lift the tray into the basket position from the flat position.

These and other features are described in, or are apparent from, the following detailed description.

BRIEF DESCRIPTION OF THE DRAWINGS

Various exemplary embodiments of the systems and methods are described in detail below, with reference to the attached drawing figures, in which:

FIG. 1 is a schematic representation of a printer/copier and output tray;

FIG. 2 is a schematic representation of a printer/copier and output tray;

DETAILED DESCRIPTION

Figure 3:
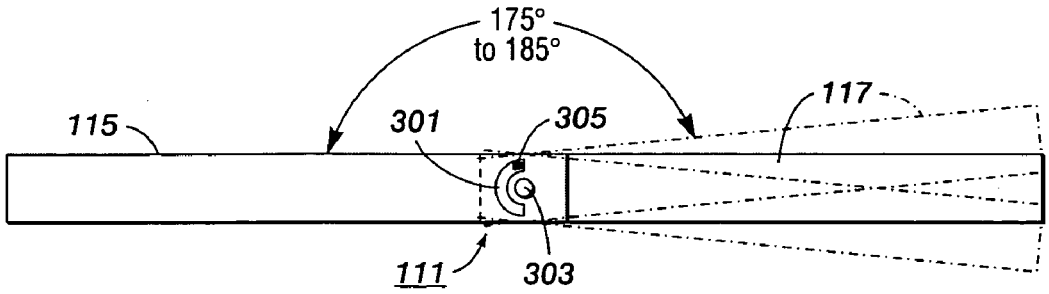
FIG. 3 is a more detailed schematic representation of the output tray shown in FIGS. 1 and 2.

Embodiments herein comprise a printing/copying media output device or terminal that includes a single media output tray that can be used both as a flat tray and a basket tray. As shown in FIGS. 1 and 2, the media output tray 109 has a first portion 115 that connects to the media output device 105 such as a printer, print engine, copier, image output terminal, etc. at point 121. The media 123, such as paper, transparencies, card stock, photosensitive material, etc. is shown in the media tray after being output by the media output device 105.

The media output tray 109 has a second portion 117 connected to the opposite end of the first portion 115 from the media output device 105, and a hinge 111 between the first portion 115 and the second portion 117. The hinge 111 connects the first portion 115 to the second portion 117. By folding the tray at the hinge 111, the same single media output tray 109 can be converted from a flat tray (FIG. 1) to a basket tray (FIG. 2).

In some embodiments herein, the hinge 111 is positioned at an approximate midpoint of the output tray 109 and the first portion 115 is approximately the same size as the second portion 117. In other embodiments, the first portion 115 and the second portion 117 can be different sizes and the hinge 111 can be non-centered, so long as the media output tray 109 can fold to form a basket that will hold the media and prevent the media from falling out of the basket.

The hinge 111 maintains a relative position between the first portion 115 and the second portion 117. When the relative position between the first portion 115 and the second portion 117 is a "first tray position", the first portion 115 and the second portion 117 form a flat output tray 109, as shown in FIGS. 1 and 3. Thus, in the first tray position, the first portion 115 lies in the same approximate plane as the second portion 117 and the angle between the first portion 115 and the second portion 117 is greater than approximately 175 degrees, can be between 175 and 185 degrees, and can be 180 degrees, for example as shown in FIG. 3.

Figure 4:
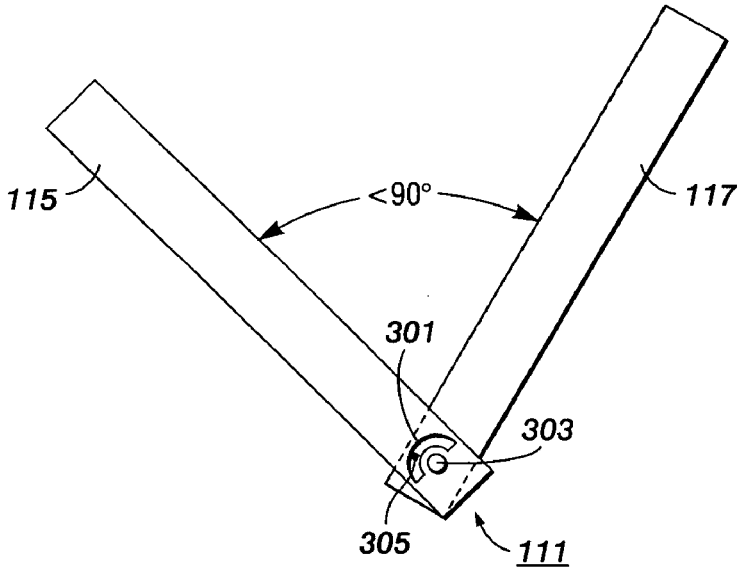
FIG. 4 is a more detailed schematic representation of the output tray shown in FIGS. 1 and 2.
Figure 5:
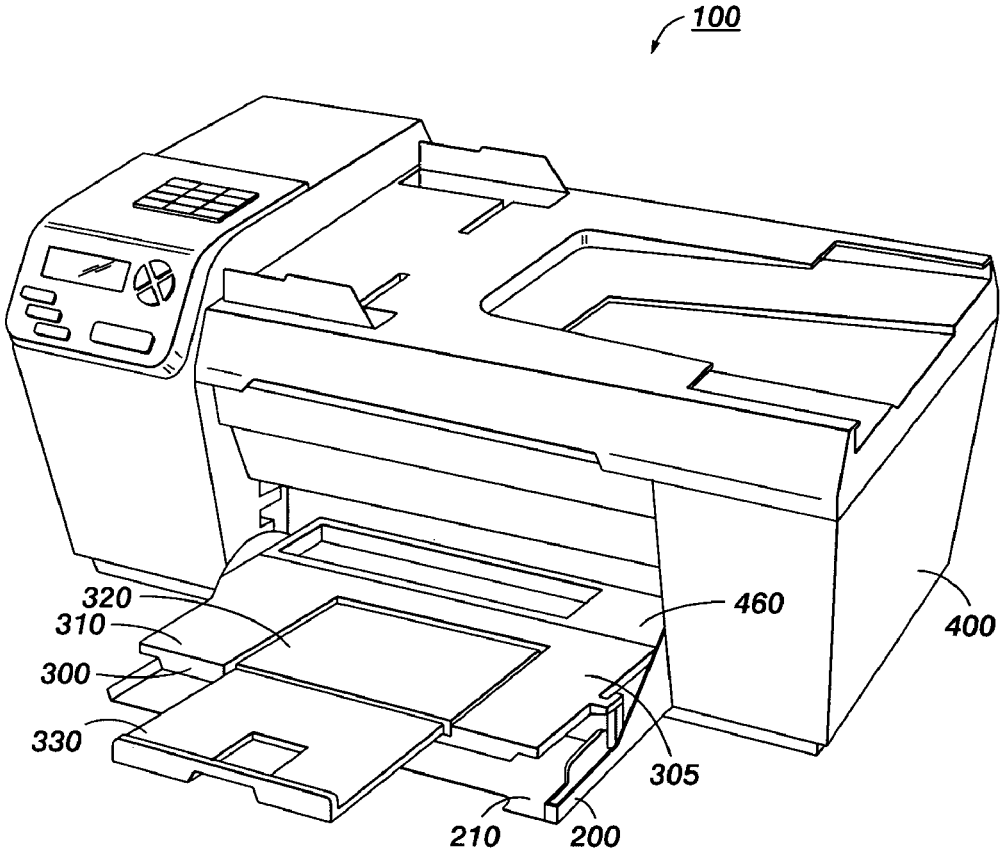
FIG. 5 is a schematic representation of a printer/copier and output tray.
Figure 6:
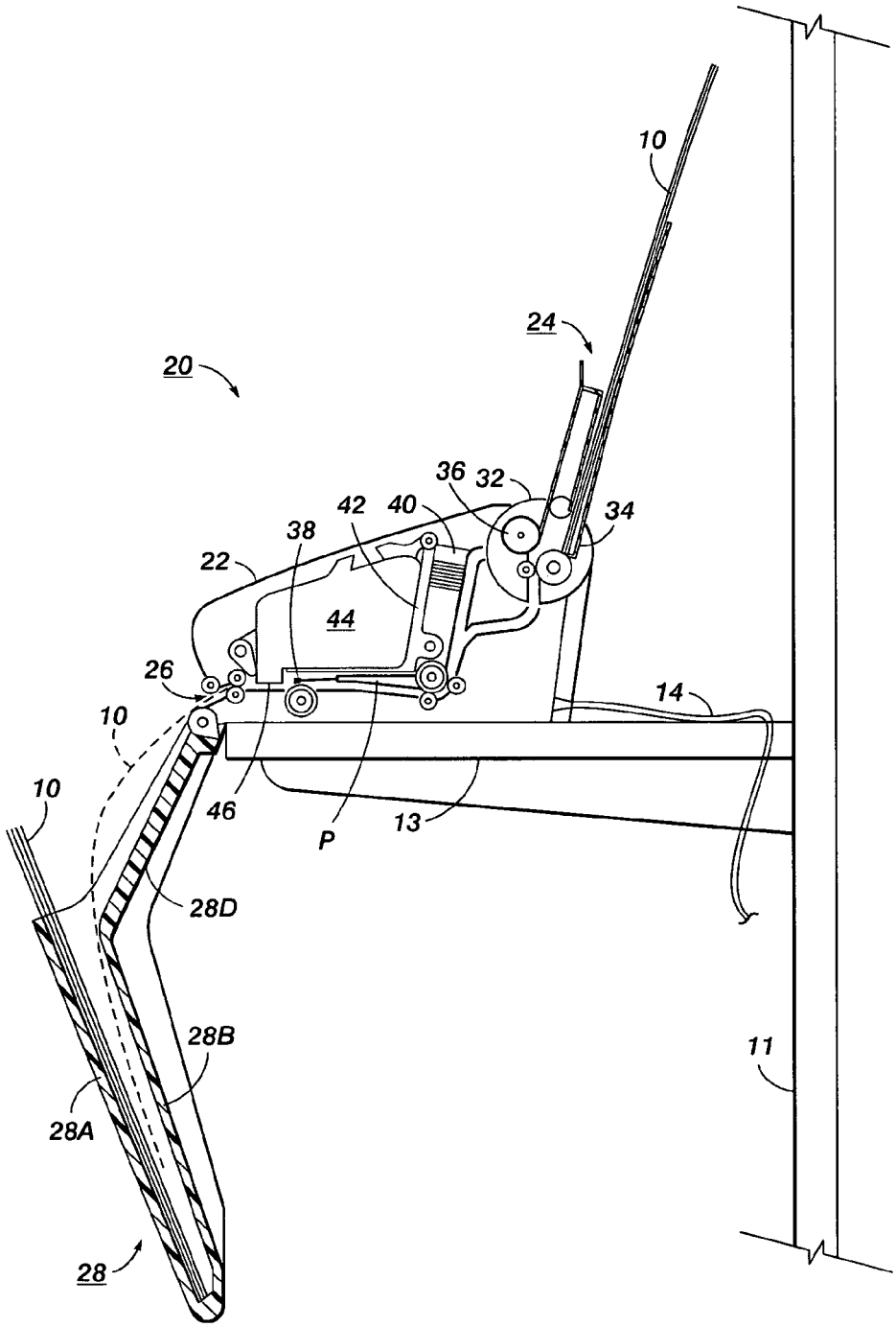
FIG. 6 is a schematic representation of a printer/copier and output tray.

When the relative position between the first portion 115 and the second portion 117 is in a "second tray position," the first portion 115 and the second portion 117 form a basket tray, as shown in FIGS. 2 and 4. Thus, when the relative position between the first portion 115 and the second portion 117 is the second tray position, the first portion 115 does not lie in the same approximate plane as the second portion 117 and an angle between the first portion 115 and the second portion 117 is less than approximately 90 (although it could be somewhat greater than 90 degrees), can be less than 60 degrees, and can be even smaller than 30 degrees. Indeed, the angle between the first portion 115 and the second portion 117 can be very small as shown in FIG. 6. The angle between the first portion 115 and the second portion 117 should be steep enough to prevent media 123 from falling from the media output tray 109 and steep enough to allow the media output tray 109 to minimize the space occupied by the media output tray 109.

As shown in FIG. 1, the media 123 lies flat on the media output tray 109 when the relative position between the first portion 115 and the second portion 117 is in the first tray position, and, as shown in FIG. 2, the media 123 sits between the first portion 115 and the second portion 117, with one edge of the media 123 resting on the hinge 111 when the relative position between the first portion 115 and the second portion 117 is in the second tray position.

A readibly detachable/attachable support 107, such as a cable, strap, or bar, can be connected to the media output tray 109 and to the media output device 105. The support 107 can be attached to output tray using any non-permanent connection including hooks, slots, snaps, magnets, screws, and any equivalents thereof. The support 107 is connected to the first portion 115 when the relative position between the first portion 115 and the second portion 117 is in the first tray position (FIG. 1). The support 107 is connected to the second portion 117 when the relative position between the first portion 115 and the second portion 117 is the second tray position (FIG. 2). In addition, a second hinge 121 connects the first portion 115 to the media output device 105 to allow the angle of the tray to be changed with respect to the printer/copier and to allow the tray to be completely folded out of the way when not in use. The support 107 is used in one embodiment to add support and make changing between tray positions easier. One ordinarily skilled in the art would understand that the hinge 111 itself (as shown in detail in FIGS. 3 and 4) could maintain the tray in either the flat or basket position, without the need for a support.

FIGS. 3 and 4 illustrate one example of the hinge 111 in greater detail. This example hinge 111 can be used with or without the support 107. While one specific embodiment of the hinge 111 is shown in FIGS. 3 and 4, one ordinarily skilled in the art would understand that any form of hinge could be utilized with embodiments herein. In FIGS. 3 and 4, item 303 represents an axle, item 301 represents a slot in the first portion 115 of the media output tray 109, and item 305 represents a stop or protrusion on (or attached to) the second portion 117 of the media output tray 109. The stop 305 fits within the slot 301 and the slot 301 limits the range of travel of the stop 305. Because the stop 305 can only move within the slot 301, the relative position between the first portion 115 and the second portion 117 is limited to the range of the slot. Gravity will maintain the stop 305 against the end of the slot 301, when the output tray 109 is in the first flat tray position. Similarly, if the center of gravity of the second portion 117 can be located past the axel 303 (if FIG. 4 is rotated slightly counter clock-wise, for example), gravity will similarly maintain the stop 305 against the other end of the slot 301, when the output tray is in the second basket tray position.

Therefore, as shown above, embodiments herein provide a single media output tray that can be used as both a flat tray and as a basket tray. This provides the user with increased flexibility regarding positioning of the printer and accommodates user preferences by providing the user with a choice between flat and basket output trays, without having to supply two separate trays. Further, embodiments herein provide a simple and easy way in which to change the tray by allowing the user to adjust the support 107 or simply allowing the user to lift the tray into the basket position from the flat position.

The word "printer" as used herein encompasses any apparatus, such as a digital copier, bookmaking machine, facsimile machine, multi-function machine, etc. which performs a print outputting function for any purpose. The details of printers, printing engines, etc. are well-known by those ordinarily skilled in the art and are discussed in, for example, U.S. Pat. No. 6,032,004, the complete disclosure of which is fully incorporated herein by reference. The following claims can encompass embodiments that print in monochrome, color, or handle color image data. All foregoing embodiments are specifically applicable to electrostatographic and/or xerographic machines and/or processes. Further, while relatively manageable size media sheets have been mentioned above, the embodiments herein are equally applicable to very large size media sheets, such as those discussed in U.S. Pat. No. 5,190,279, the complete disclosure of which is incorporated herein by reference.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A media output tray comprising:

a first portion adapted to connect to a media output device;

a second portion connected to said first portion;

a hinge between said first portion and said second portion; and a support connected to said media output tray and to said media output device, wherein said hinge maintains a relative position between said first portion and said second portion, wherein said relative position comprises:

a first tray position, wherein in said first tray position said first portion and said second portion form a flat output tray; and a second tray position, wherein in said second tray position said first portion and said second portion form a basket tray, and wherein said support is connected to said first portion and disconnected from said second portion in said first tray position, and said support is connected to said second portion and disconnected from said first portion in said second tray position.

2. The media output tray according to claim 1, further comprising a second hinge connecting said first portion to said media output device.

3. The media output tray according to claim 1, wherein media lies flat on said media output tray in said first tray position, and said media sits between said first portion and said second portion, resting on said hinge in said second tray position.

4. The media output tray according to claim 1, wherein said support comprises a first end connected to said media output device and a second end connected to said media output tray.

5. The media output tray according to claim 1, wherein said basket tray is adapted to hold media and prevent said media from falling out of said basket tray.

6. A media output tray comprising:

a first portion adapted to connect to a media output device;

a second portion connected to said first portion;

a hinge between said first portion and said second portion; and a support connected to said media output tray and to said media output device, wherein said hinge maintains a relative position between said first portion and said second portion, wherein said relative position comprises:

a first tray position, wherein in said first tray position said first portion lies in the seame approximate plane as said second portion and an angle between said first portion and said second portion is approximately 180 degrees; and a second tray position, wherein in said second tray position said first portion does not lie in the same approximate plane as said second portion and an angle between said first portion and said second portion is less than approximately 90 degrees, and wherein said support is connected to said first portion and disconnected from said second portion in said first tray position, and said support is connected to said second portion and disconnected from said first portion in said second tray position.

7. The media output tray according to claim 6, further comprising a second hinge connecting said first portion to said media output device.

8. The media output tray according to claim 6, wherein media lies flat on said media output tray in said first position, and said media sits between said first portion and said second portion, resting on said hinge in said second tray position.

9. The media output tray according to claim 6, wherein said support comprises a first end connected to said media output device and a second end connected to said media output tray.

10. The media output tray according to claim 6, wherein said second tray position said first portion and said second portion form a basket tray and wherein said basket tray is adapted to hold media and prevent said media from falling out of said basket tray.

11. A media output tray comprising:

a first portion adapted to connect to a media output device;

a second portion connected to said first portion;

a hinge between said first portion and said second portion; and a support connected to said media output tray and to said media output device, wherein said hinge is positioned at an approximate mid-point of said output tray and said first portion is approximately the same size as said second portion, wherein said hinge maintains a relative position, between said first portion and said second portion, wherein said relative position comprises:

a first tray position, wherein said first portion lies in the same approximate plane as said second portion and an angle between said first portion and said second portion is approximately 180 degrees; and a second tray position, wherein said first portion does not lie in the same approximate plane as said second portion and an angle between said first portion and said second portion is less than approximately 90 degrees, and wherein said support is connected to said first portion and disconnected from said second portion in said first tray position, and said support is connected to said second portion and disconnected from said first portion in said second tray position.

12. The media output tray according to claim 11, further comprising a second hinge connecting said first portion to said media output device.

13. The media output tray according to claim 11, wherein media lies flat on said media output tray in said first tray position, and said media sits between said first portion and said second portion, resting on said hinge in said second tray position.

14. The media output tray according to claim 11, wherein said support comprises a first end connected to said media output device and a second end connected to said media output tray.

15. The media output tray according to claim 11, wherein in said second tray position said first portion and said second portion form a basket tray and wherein said basket tray is adapted to hold media and prevent said media from falling out of said basket tray.

16. A printing apparatus comprising:

a printer;

a media output tray connected to said printer, wherein said media output tray comprises:

a first portion connected to said printer;

a second portion connected to said first portion;

a hinge between said first portion and said second portion; and a support connected to said media output tray and to said media output device, wherein said hinge maintains a relative position between said first portion and said second portion, wherein said relative position comprises:

a first tray position, wherein in said first tray position said first portion and said second portion form a flat output tray; and a second tray position, wherein in said second tray position said first portion and said second portion form a basket tray, and wherein said supnort is connected to said first portion and disconnected from said second portion in said first tray position, and said support is connected to said second portion and disconnected from said first portion in said second tray position.

17. The printing apparatus according to claim 16, further comprising a second hinge connecting said first portion to said printer.

18. The printing apparatus according to claim 16, wherein said printer comprises at least one of an electrostatographic and a xerographic printer.

19. The printing apparatus according to claim 16, wherein said support comprises a first end connected to said media output device and a second end connected to said media output tray.

20. The printing apparatus according to claim 16, wherein in said second tray position said first portion and said second portion form a basket tray and wherein said basket tray is adapted to hold media and prevent said media from falling out of said basket tray.

* * * * *